United States Patent [19]

Tatara et al.

[11] Patent Number: 4,934,462

[45] Date of Patent: Jun. 19, 1990

[54] CONTROL DEVICE FOR A DUAL FUNCTION MACHINE

[75] Inventors: Andre' Tatara, Racine, Wis.; Robert McCaig, Basingstoke, England; Jose Andiano, Lury-sur-Arnon, France

[73] Assignee: J. I. Case Company, Racine, Wis.

[21] Appl. No.: 396,385

[22] Filed: Aug. 21, 1989

[30] Foreign Application Priority Data

Nov. 21, 1988 [FR] France ..... 88-15125

[51] Int. Cl.[5] ..... E02F 9/24; B60N 2/14

[52] U.S. Cl. ..... 172/2; 180/331; 37/DIG. 1; 172/435

[58] Field of Search ..... 172/2, 431, 435; 180/326, 329, 330, 331; 37/DIG. 3, DIG. 1, 117.5

[56] References Cited

U.S. PATENT DOCUMENTS

| | | | |
|---|---|---|---|
| 4,026,379 | 5/1977 | Dunn et al. | 180/331 |
| 4,372,341 | 2/1983 | Crawley | 180/326 X |
| 4,730,691 | 3/1988 | Grigg | 180/326 X |

FOREIGN PATENT DOCUMENTS

| | | | |
|---|---|---|---|
| 1211494 | 2/1966 | Fed. Rep. of Germany | 180/331 |
| 2546832 | 4/1977 | Fed. Rep. of Germany | 180/330 |
| 2705980 | 8/1978 | German Democratic Rep. | 180/330 |
| 251530 | 10/1988 | Japan | 37/DIG. 1 |

*Primary Examiner*—Randolph A. Reese
*Assistant Examiner*—Jeffrey L. Thompson
*Attorney, Agent, or Firm*—Peter N. Jansson Ltd.

[57] ABSTRACT

A control device for use in a dual function machine includes a first disconnecting device for connection between a first operator's control knob and at least one control valve usable for controlling a first function of the machine. A second disconnecting device is provided for connection between a second operator's control knob and at least one second control valve usable for controlling a second function of the machine. The disconnecting devices are arranged for mounting in actuating relationship to a swivel-type operator's seat, the first disconnecting device being actuated for disabling the second function when said seat is in a first position for operating the first function and the second disconnecting device being actuated for disabling the first function when the seat is in a second position for operating the second function.

12 Claims, 1 Drawing Sheet

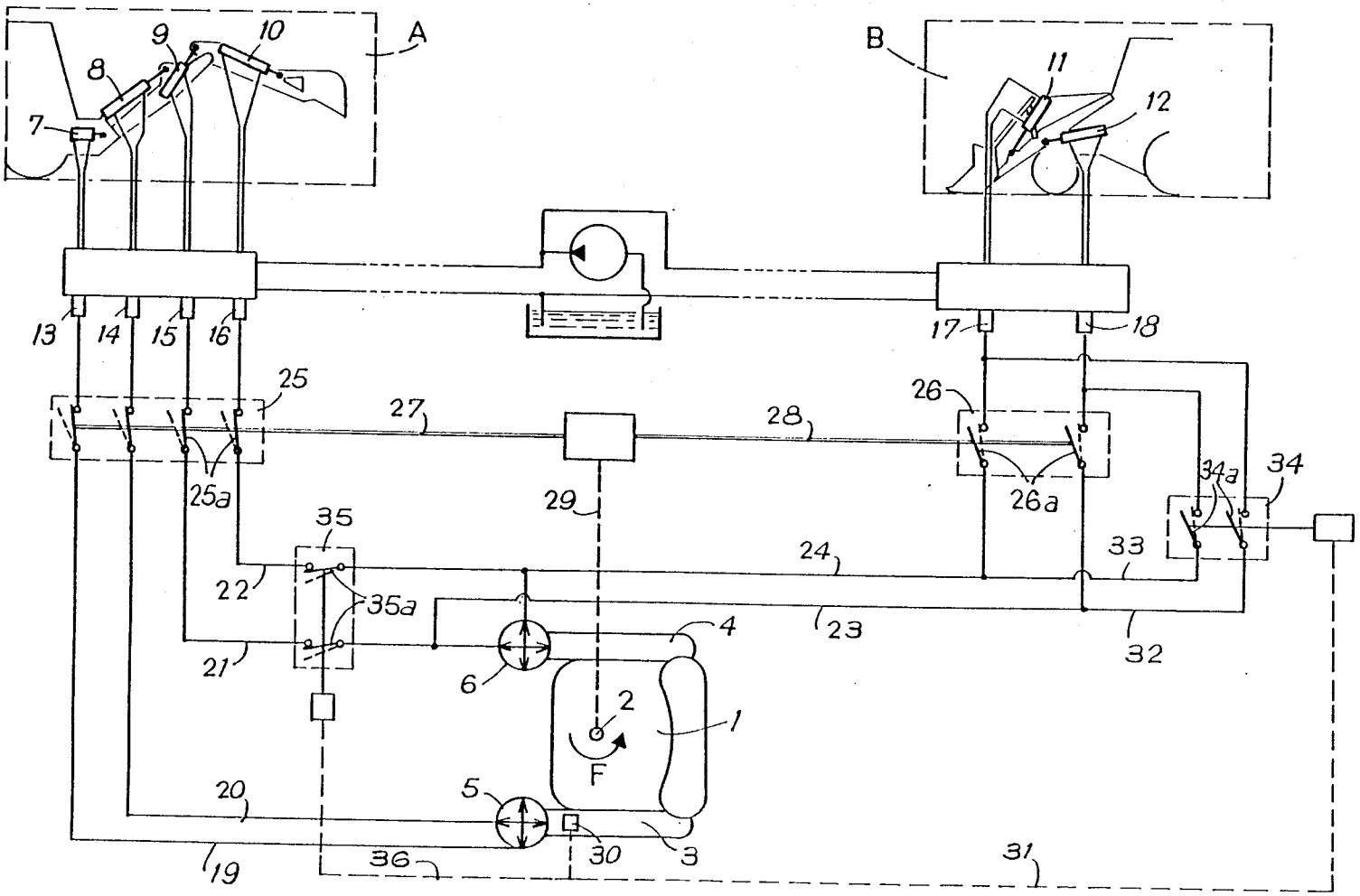
A
B
1
2
3
4
5
6
7
8
9
10
11
12
13
14
15
16
17
18
19
20
21
22
23
24
25
25a
26
26a
27
28
29
30
31
32
33
34
34a
35
35a
36
F

CONTROL DEVICE FOR A DUAL FUNCTION MACHINE

FIELD OF THE INVENTION

This invention is related generally to machine control devices which are sensitive to an operator's position and, more particularly, to a control device for use on a dual function machine on which the device may enable or disable a particular machine function depending on the position of a swiveling operator's seat.

BACKGROUND OF THE INVENTION

Certain types of machinery employ a single operator but are equipped to perform at least two, and perhaps more, separate functions. These functions may be for the same overall purpose, e.g. the fabrication of a part, construction of a building, or installation of an underground pipeline but each function of the machine is employed for a different purpose to achieve the overall end. Such machines often have different items of functional equipment disposed at different locations thereon with the operator selecting appropriate controls by changing body position, often by moving from position to position in a swivel-type operator seat. To prevent inadvertent operation of the actuating controls for an item of machine equipment which is not then in use, there is a need for a control device which permits the operation of each of the various equipment items according to the position of the operator's seat. While this invention will have application for multiple function machines generally, it is described particularly with respect to an item of construction machinery.

Excavator vehicles, commonly known as "mechanical shovels", are known which include two sets of earth-moving equipment, both of which are hydraulically controlled from a single control position. In general, these sets of equipment are disposed at opposite longitudinal ends of the vehicle chassis, which is also provided with driving and/or steerable wheels. One of these equipments, namely a digger or backhoe is used in particular for digging trenches, and the vehicle must be held in a stationary position in order for said equipment to be used. In contrast, the equipment at the other end, namely a loader or shovel per se requires the operator to drive the vehicle while it is in use since materials picked up in the shovel are subsequently tipped into a truck for removal.

The control position on the vehicle is therefore equipped with two groups of controls, each corresponding to one of the sets of equipment, and the operator sits on a swivelling seat mounted on a platform of the vehicle.

In each of its extreme positions, the swivelling seat gives the operator easy access to the corresponding group of controls, and in particular the operator has access to the vehicle steering wheel when the shovel is in use. When using the shovel, the shovel equipment must be capable of being controlled by one hand only so as to leave the other hand free to steer the vehicle.

It is also recalled that in this type of vehicle the various elements constituting either of the sets of equipment are actuated by means of at least one hydraulic actuator under the control of a control valve which is in turn servo-controlled to the position of a knob disposed within reach of the operator when sitting in the control position.

The term "knob" is used herein to designate any kind of manually-operated lever, handle, pushbutton, etc. It is also used to cover a set of such devices, and a typical example would be in the form of a "joystick" providing independent positive and negative control effects for forward and reverse movement of the stick and for left and right movement of the stick.

Other excavator vehicles, which may be referred to as "mechanical diggers", have a turret supporting a single set of earth-moving equipment, with the turret being pivotally mounted on a chassis provided with displacement means, e.g. wheels or crawler tracks. In this case, the vehicle control position is disposed on the pivoting turret and the operator generally has remote-control knobs both for controlling the earth-moving equipment and for controlling vehicle displacement.

OBJECTS OF THE INVENTION

It is an object of this invention to overcome some of the problems and shortcomings of the prior art.

Another object of this invention is to provide a control device for selectively enabling and disabling portions of a multi-function machine.

Another object of this invention is to provide a control device whereby functions of a machine may be selectively enabled or disabled depending upon the position of an operator's seat.

Still another object of the invention is to provide a control device which is useful for multi-function earth-moving and excavating equipment.

Yet another object of the invention is to provide a control device which may be adapted to control systems of the electrical, hydraulic or pneumatic type. How these and other objects are accomplished will become apparent from the detailed description taken in conjunction with the drawing.

SUMMARY OF THE INVENTION

A control device for use in a dual function machine includes a first disconnecting device for connection between a first operator's control knob and at least one control valve usable for controlling a first function of the machine. A second disconnecting device is provided for connection between a second operator's control knob and at least one second control valve usable for controlling a second function of the machine. The disconnecting devices are arranged for mounting in actuating relationship to a swivel-type operator's seat, the first disconnecting device being actuated for disabling the second function when said seat is in a first position for operating the first function and the second disconnecting device being actuated for disabling the first function when the seat is in a second position for operating the second function.

It should immediately be underlined that the control paths may be of the electrical type, of the hydraulic type, or of the pneumatic type, since in each case it serves solely to control, i.e. open partially or totally, the valves which control the actuators. The actuators themselves are powered by hydraulic fluid under high pressure and the flow rate of the hydraulic fluid is adjusted by the amount the control valves are opened.

The transmission paths are thus either electrical cables or else ducts conveying a control fluid, and the control valves themselves are either electrically-controlled valves or else valves which are opened under hydraulic or pneumatic control.

Under such conditions, the on/off switch disposed in each transmission is constituted either by a multi-pole electrical switch whose moving contacts are caused to move together with the swivelling portion of the operator's seat, or else by a slide valve where the slide moves as a function of the position of the operator's seat and completely opens or closes the ducts connecting the knobs to the control valves.

The invention will be better understood and its advantages and various secondary characteristics will appear more clearly from reading the following description of a preferred embodiment in which transmission is provided electrically. It should nevertheless be understood that the invention is not limited to this type of transmission and the person skilled in the art will easily transpose the characteristics of an electrical transmission to a hydraulic or a pneumatic transmission.

BRIEF DESCRIPTION OF THE DRAWINGS

FIG. 1 is a schematic diagram of a control device of the invention.

DETAILED DESCRIPTIONS OF PREFERRED EMBODIMENTS

With reference to FIG. 1, it can be seen that the control position includes a seat 1 which is pivotally mounted on the platform of an excavator vehicle which includes two sets of earth-moving equipment which are represented diagrammatically by overall references A and B. The seat 1 is facing equipment A which is of the "digger" or "backhoe" type, but it can readily be swivelled to face equipment B which is of the "loader" or "shovel" type, by rotating through 180° in the direction of arrow F about a pivot axis 2. Remote control knobs 5 and 6 are disposed at the ends of the arms 3 and 4 of the seat 1. Under conditions described in greater detail below, these remote-control knobs serve to control the various elements of each of the sets A and B of earth-moving equipment, i.e. hydraulic actuators 7, 8, 9, and 10 in equipment A and actuators 11 and 12 in equipment B. Each of these actuators is powered by hydraulic fluid under pressure, respectively via control valves 13, 14, 15, and 16 for equipment A, and via control valves 17 and 18 for equipment B. Each of these control valves is opened, optionally progressively, under the control of the operator manipulating the remote control knobs 5 and 6.

To this end, an appropriate means of transmitting a control signal is provided between each knob and the control valves, with the transmitting means being electrical in this case and with the valves 13 to 18 being electrically-controlled valves.

Electrical paths 19 and 20 connect the electrically-controlled valves 13 and 14 of equipment A to knob 5, and similarly paths 21 and 22 connect valves 15 and 16 also of equipment A and knob 6. Knob 6 is additionally connected to the electrically controlled valves 17 and 18 of equipment B via electrical paths 23 and 24.

Thus, there is one group of paths made up of paths 19, 20, 21 and 22 corresponding to equipment A and a second group of paths made up of paths 23 and 24 corresponding to equipment B. Each of these groups includes an on/off switch of the multi-pole type, with the switch corresponding to equipment A being given an overall reference 25 and the switch corresponding to the equipment B being given an overall reference 26. The moving electrical switching elements of the switch 25, i.e. its set of moving contacts **25*a*, is coupled to a rod 27 or the like, and the moving contracts 26*a* of the switch 26 are coupled to a control rod 28. The two moving members 27 and 28 are themselves controlled as a function of the position of the swivelling portion of the seat 1. More precisely, and as shown in the drawing, the moving contacts 25*a* provide continuity in paths 19, 20, 21 and 22 when the seat 1 is in its extreme position corresponding to using equipment A. Under such conditions, the moving contacts 26*b* are open, thereby preventing the valves 17 and 18** of the equipment B from being controlled.

In contrast, if the seat 1 swivels in the direction of arrow F in order to take up its other extreme position corresponding to using equipment B, then the sets of moving contacts **25*a* and 26*a* are caused to take up their positions shown in dashed lines in the drawing under the control of their moving actuator members 27 and 28 which are moved by control line 29 so as to follow the position of the seat 1. In this second position of the moving contacts 25*a* and 26*a***, equipment A can no longer be used.

In this respect, it will be observed that when the seat 1 is in its position shown in FIG. 1, both knobs 5 and 6 are used by the operator for controlling the various elements of equipment A. However, when the seat 1 is in the appropriate position for controlling equipment B, only the knob 6 is connected to the electrical control valves 17 and 18 of the equipment, while knob 5 is completely disconnected. As a result, the operators's left hand is available for the other controls of the vehicle, and in particular for steering it. This is particularly advantageous when equipment B is, as shown, constituted by a mechanical shovel.

It is already mentioned above that paths 21 and 22 of equipment A and paths 23 and 24 of equipment B are connected to the same knob 6. In order to facilitate utilization of the vehicle, it is advantageous of the paths 19, 20, 21, 22, 23, 24 of the two sets of equipment which are connected to the same knob to correspond to analogous or identical elements in each of the two sets of equipment. For example, it may be observed that paths 22 and 24 for controlling electrically-controlled valves 16 and 17 are connected to knob 6 and that in both sets of equipment they correspond to similar items, namely the earth-engaging shovel or bucket.

Provision is also made for at least one of the sets of equipment A and B to be usable even if the seat 1 is not in one of its extreme positions. With reference to FIG. 1, this means that equipment A, for example, may be used not only when the seat 1 is in its position corresponding to the extreme position shown in the drawing, but also when it is in an intermediate position between said extreme position and the other extreme position corresponding to that employed when using equipment B. In the example shown, these two extreme positions are about 180° apart, but this value is not essential.

In practice, the mechanical members included in the control line 29 serve to predetermine, for at least one of the sets of equipment, a position of the seat 1 beyond which said equipment can be used. With respect to equipment A, it is advantageous for this predetermined position to be very close to the extreme position corresponding to normal operating conditions for equipment B. In other words, the seat 1 may be swivelled through at least 150° from its position shown in the drawing before control line 29 causes the moving contacts **25*a* and 26*a*** to switch positions from the position shown in solid lines to the position shown in dashed lines.

To put it yet another way, once the seat 1 is in an extreme position to operate one set of equipment, equipment A for example, the seat 1 must be rotated through an arc of at least 150° before the positions of contacts 25*a*, 26*a* are switched to permit operation of equipment b. Such rotation would bring the seat 1 to within no more than 30° of the extreme position to operate equipment B. Conversely and if the seat 1 is in the extreme position to operate equipment B, it must be rotated at least 150° before equipment A can be operated. Such rotation would bring the seat 1 to within no more than 30° of the extreme position to operate equipment A.

In some cases, the switchover could occur as soon as the seat 1 leaves its extreme position which corresponds to using equipment B to take up a position shown in solid lines in the drawing.

Finally, it should be underlined that when the seat 1 is in one or other of its extreme positions, e.g. the position shown in FIG. 1 which corresponds to normal utilization of equipment A, it may be advantageous, in an exceptional circumstance, to be able to make use of equipment B.

To this end, an auxiliary control 30 is provided (preferably on one of the arms of the seat 1) serving to bridge the effect of paths 23 and 24 being opened, e.g. by means of a transmission shown in diagrammatically at 31. Each of paths 23 and 24 includes a bypass line 32 or 33 connected to bypass switch 26. The bypass lines 32 and 33 have an auxiliary switch 34 connected therein with its moving contacts 34*a* normally being in an open position as shown by solid lines in the drawing. When the auxiliary control 30 is actuated, the moving contacts 34*a* take up the position shown in dashed lines, thereby bridging across open contacts 26*a* and making it possible to use equipment B under the control of knob 6.

Naturally, it is possible to prevent elements of equipment A being controlled simultaneously by the knob 6 during such exceptional utilization of equipment B. To this end, the paths 21 and 22 may be provided with a secondary switch 35 whose moving contracts 35*a* are normally in the closed position, but are moved to the open position as shown by dashed lines whenever the operator actuates the auxiliary control 30. A secondary transmission 36 is provided between the control 30 and the secondary switch 35.

While only a few of the embodiments of the invention have been shown and described, it is not intended to be limited thereby.

I claim:

1. A control valve for use in a machine having first and second sets of equipment, each to be employed for a different purpose, the control device including:

a first disconnecting device for connection between a first operator's control knob and at least one control valve usable solely for controlling a first set of equipment of said machine;

a second disconnecting device for connection between a second operator's control knob and at least a second control valve usable solely for controlling a second set of equipment of said machine;

said disconnecting devices being arranged for mounting in actuating relationship to an operator's seat arranged for swiveling, non-translational movement, said first disconnecting device disabling said second set of equipment when said seat is in a first position for operating said first set of equipment, said second disconnecting device disabling said first set of equipment when said seat is in a second position for operating said second set of equipment.

2. THe control device of claim 1 wherein said first operator's control knob and said one control valve are of the electrical type and said second disconnecting device is a multipole electrical switch.

3. The control device of claim 2 wherein said mounting of said disconnect devices may be in a manner such that said first set of equipment is operative at positions of said seat when said second set of equipment is disabled and said second set of equipment is operative at positions of said seat when said first set of equipment is disabled.

4. The control device of claim 3 wherein said operator's seat may be swivelled through an arc of about 180 degrees and said first disconnecting device is actuated for disabling said second set of equipment when said seat is within no more than 30 degrees of said first position.

5. The control device of claim 4 further including an auxiliary control whereby said second set of equipment is permitted to be actuated notwithstanding that said seat is in said first position.

6. A control device for an excavator vehicle having two sets of earth-moving equipment disposed at respective longitudinal and/or transverse ends of a vehicle chassis, each set of equipment having a plurality of hydraulic actuators, each actuator being under the control of a control valve, said control device including:

a seat for a vehicle operator, said seat being swivel mounted on the vehicle platform to swivel between two extreme positions, the swivelling portion of said seat having at least two remote control knobs provided thereon for controlling said control valves;

a plurality of control paths disposed between said control knobs and corresponding control valves for the actuators of at least one of said sets of equipment, said paths being split into two groups of paths each of said groups corresponding to one of said sets of equipment;

a circuit interruption device embodied as an on/off switch connected in each of said paths with the moving member of each on/off switch being controlled as a function of the position of the swivelling portion of said seat, thereby preventing both of said sets of equipment from being operated simultaneously.

7. A control device according to claim 6, wherein at least one of said control paths is of the electrical type and at least one of said control valves is of the electrically-controlled type, said circuit interruption device including multi-pole switches, said switches each comprising a plurality of moving electrical switching elements, the positions of said switching elements being controlled as a function of the position of the swivelling portion of said seat.

8. A control device according to claim 7, wherein said paths to the electrically-controlled valves corresponding to at least one set of said equipment is electrically connected to a common remote control knob.

9. A control device according to claim 7, wherein said electrical paths are grouped together for coacting with said seat in such a manner that in one of the extreme positions of said swivelling seat, one of said remote control knobs is inactive.

10. A control device according to claim 7, wherein said electrical paths of said sets of equipment are electrically connected to the electrically-controlled valves for activating said one of said sets of earth-moving equipment when said swivelling portion of said seat is in any position lying between its first extreme position corresponding to normal control of said set of equipment and a predetermined position distinct from its second extreme position.

11. A control device according to claim 10 wherein said extreme positions of said swivelling seat are separated angularly by about 180° and wherein said predetermined position is within no less than 30° of said second extreme position.

12. A control device according to claim 6, wherein in at least one of said positions of said seat for normal control of one of said sets of earth-moving equipment, an auxiliary control is provided for selectively establishing connection between said valves for controlling the other said set of equipment and at least one of said remote control knobs.

* * * * *